US005465787A

United States Patent [19]

Roth

[11] Patent Number: 5,465,787

[45] Date of Patent: Nov. 14, 1995

[54] FLUID CIRCULATION APPARATUS

[75] Inventor: Brian A. Roth, The Woodlands, Tex.

[73] Assignee: Camco International Inc., Houston, Tex.

[21] Appl. No.: 282,795

[22] Filed: Jul. 29, 1994

[51] Int. Cl.[6] ..... E21B 4/04

[52] U.S. Cl. ..... 166/66.4; 166/319; 175/61; 175/62

[58] Field of Search ..... 166/316, 319, 166/66.4; 175/38, 61, 62, 100

[56] References Cited

U.S. PATENT DOCUMENTS

| | | | |
|---|---|---|---|
| 2,833,517 | 5/1958 | Bobo | 175/317 X |
| 3,941,190 | 3/1976 | Conover | 175/317 X |
| 4,373,582 | 2/1983 | Bednar et al. | 166/66.4 |
| 4,768,598 | 9/1988 | Reinhardt | 175/26 |
| 5,127,477 | 7/1992 | Schultz | 166/336 |
| 5,236,047 | 8/1993 | Pringle et al. | 166/369 |
| 5,251,703 | 10/1993 | Skinner | 166/319 X |
| 5,314,032 | 5/1994 | Pringle et al. | 175/74 |
| 5,316,094 | 5/1994 | Pringle | 175/74 |
| 5,323,853 | 6/1994 | Leismer et al. | 166/55 |
| 5,373,898 | 12/1994 | Pringle | 166/72 |

*Primary Examiner*—Roger J. Schoeppel

[57] ABSTRACT

A fluid circulation apparatus for interconnection with a wellbore tubing string for particular use in drilling deviated wellbores, such as with coiled tubing. The circulation apparatus has a tubular body member with a longitudinal bore extending therethrough and threads for interconnection with a tubing string. A fluid communication port extends through a sidewall of the tubular body member, and a valve is placed thereacross for selectively permitting and preventing fluid flow through the fluid communication port. The valve is biased in a normally closed position by way of a spring. Fluid control means, such as a hydraulic fluid source conveyed through the tubing string, operates the valve in response to electrical signals sent to the fluid control means from the earth's surface.

7 Claims, 3 Drawing Sheets

FLUID CIRCULATION APPARATUS

BACKGROUND OF THE INVENTION

1. Field of the Invention

The present invention relates to a fluid circulation apparatus used for passing fluid from an interior of a drill string to the wellbore's annulus upon command from the surface and, more particularly, to a fluid circulation apparatus that can be used in directional drilling.

2. Description of Related Art

With the world's known oil reserves declining, extraordinary efforts are being made to continue oil production from existing oil fields. One such method is to drill a wellbore at an incline or even horizontally to reach oil trapped in relatively small pockets. Also, a wellbore can be drilled laterally from an existing wellbore to intersect one or more subterranean faults which can permit additional trapped oil to flow to the wellbore for recovery. The art of being able to steer or guide a drill string at an incline or horizontally to a desired location is usually referred to as "directional drilling". To understand the location of the advancing drill bit from the earth's surface, a directional driller uses various techniques. In some cases, acoustical pulses in the drilling mud are measured and in others sensitive electronic downhole telemetry (telemetric) devices are utilized.

A circulation valve is used to redirect the flow path of drilling fluid, to enable the drill bit to clear debris, drill cuttings, sloughed formation particles or other such unconsolidated particles which may be restricting movement of either the drill string, or drilling mud from the bit. Since directional drilling is dependent upon downhole motors operated by flowing mud, the circulation valve is necessary to maintain circulation in the drilled interval while the drilling motor is stopped. For this reason it is necessary to be able to close the circulation valve, and reopen it intermittently while drilling. A circulation sub provides a controllable opening so that drilling fluid can be passed from the inside of the drill string to the wellbore's annulus. Typically, circulation subs are mechanically actuated by the dropping of a metal bar or plug within the drill string that causes a localized fluid pressure increase that opens the circulation ports. This type of prior circulation sub is shown in U.S. Pat. No. 3,941,190. This prior circulation sub has the disadvantage of requiring the operator to retrieve or "fish" out the bar or ball before drilling can continue. This prior circulation sub will not close, so it is non-resettable. Additionally, in horizontal wellbores, the ball or bar most likely will not pass downhole to the circulation sub due to the lack of gravity assistance in the horizontal sections of the wellbore.

Other circulation subs that do not require the use of a dropped ball or bar utilize internal pressure relief valves, as shown in U.S. Pat. Nos. 2,833,517 and 4,768,598, acoustic signals, as shown in U.S. Pat. No. 4,373,582, and a dedicated hydraulic control line, as shown in U.S. Pat. No. 5,236,047 (which is commonly assigned hereto). The circulation sub shown in U.S. Pat. No. 5,236,047 utilizes the application of hydraulic fluid through a dedicated control line to open the circulation ports in the circulation sub to permit the fluid to escape to the annulus.

Directional drilling systems will often utilize extremely sensitive downhole electronic measuring devices (often called Measurement-While-Drilling equipment or "MWD") to enable the operator at the earth's surface to determine the location of the advancing drill string and its direction of advancement. Due to the extreme sensitivity of the MWD equipment, other downhole equipment must be designed to not interfere with the MWD equipment. While the circulation sub shown in U.S. Pat. No. 5,236,047 can be used in highly deviated wellbores and adjacent the extremely sensitive MWD equipment, it does require the use of a dedicated source of hydraulic fluid to operate, which may not be feasible if other hydraulically operated downhole tools are to be operated from the same hydraulic fluid source.

There is a need for a circulation sub that can be used in highly deviated wellbores and adjacent MWD equipment, and which can be actuated from the earth's surface by a signal separate from fluid which is used to open or close the circulation ports.

SUMMARY OF THE INVENTION

The present invention has been contemplated to overcome the foregoing deficiencies and meet the above described needs. Specifically, the present invention is a fluid circulation apparatus for interconnection with a tubing string, such as a drill string, that is placed within a wellbore. More specifically, the apparatus includes a tubular body member having a longitudinal bore extending therethrough, and having devices or threads for interconnection with the tubing string. At least one fluid communication port extends through a sidewall of the tubular body member, and a valve is placed thereacross for selectively permitting and preventing fluid flow through the fluid communication port. The valve is biased, such as by a spring, in a normally closed position to prevent accidental release of drilling fluids in the event that the valve operation mechanism fails. A fluid control device operates the valve in response to electrical signals sent from the earth's surface.

Whereas some prior fluid circulation subs could not be effectively utilized in deviated and horizontal wellbores, the present invention can be easily operated therein due to the fluidic operation of the valve. Whereas some prior fluid circulation subs could not be effectively utilized adjacent sensitive MWD equipment, the present invention can be successfully used because of the use of the relatively low power electrical control signal used to operate the hydraulic controls, which in turn open the fluid circulation ports. Further, the present invention uses hydraulic fluid from an non-dedicated source, so the fluid circulation ports can be operated independently from other hydraulically operated downhole tools without the need for multiple dedicated fluid control lines.

DETAILED DESCRIPTION OF THE PREFERRED EMBODIMENTS

As has been described generally above, the present invention is a fluid circulation apparatus for interconnection with a wellbore's tubing string for particular use in drilling deviated wellbores. The fluid circulation apparatus has a tubular body member with a longitudinal bore extending therethrough and threads on each end for interconnection with a tubing string. At least one fluid communication port extends through a sidewall of the tubular body member, and a valve is placed across the at least one fluid circulation port for selectively permitting and preventing drilling fluid flow from an interior of the longitudinal bore to the wellbore's annulus. The valve is biased in a normally closed position by way of a spring so that in the event that the valve operating devices fail, drilling fluid will be prevented from escaping to the annulus. Fluid control means, such as hydraulic fluid, operates the valve in response to electrical signals sent from the earth's surface.

It should be understood that the fluid circulation apparatus of the present invention can be used in any drilling operation that needs a mechanism for venting drilling fluid from the drill string to the annulus in a controlled manner. Specifically, the fluid circulation apparatus is used with conventional rotary drilling (where the drill string is rotated from the surface) and with downhole motors and turbines. The fluid circulation apparatus is used to drill a relatively straight wellbore, an inclined wellbore, a deviated wellbore that has several changes in direction, and a horizontal wellbore. Additionally, the fluid circulation apparatus of the present invention is used with a conventional drill string, formed from interconnected lengths of pipe, and with coiled tubing, which is a continuous length of tubing which is spooled into the wellbore, both of which are well known in the art.

Figure 1:
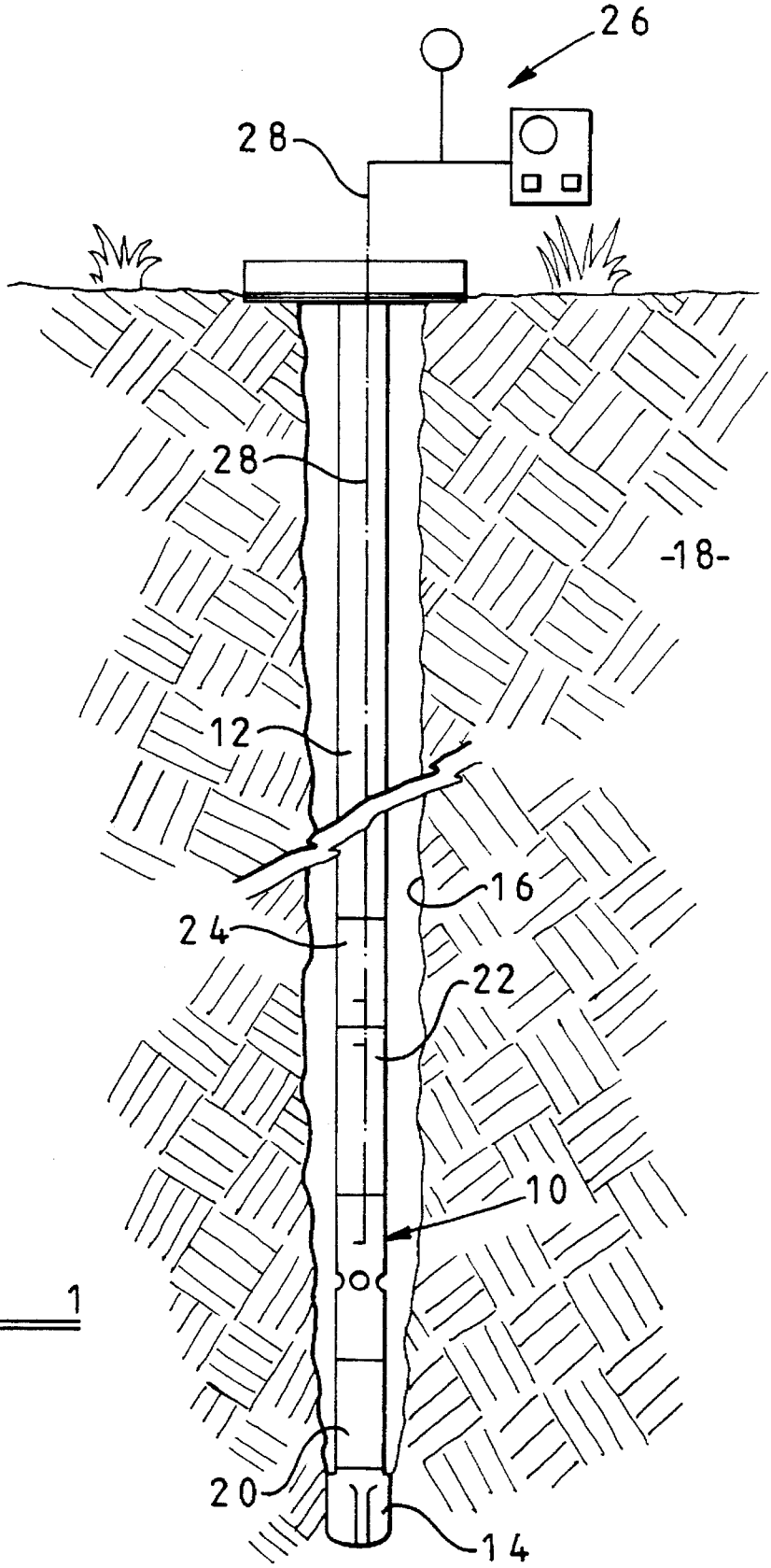
FIG. 1 is a semidiagramatic side elevational view of one preferred embodiment of a fluid circulation apparatus embodying the present invention shown connected to a tubing string used to drill a subterranean wellbore.

As shown in FIG. 1, one preferred embodiment of a fluid circulation apparatus 10 of the present invention is shown connected to a drill string 12. The drill string 12 can be a conventional multi-pipe drill string, but for the purposes of the present discussion it will be assumed that the drill sting 12 is coiled tubing. Connected to a lower end of the drill string 12 is a drill bit 14, which when rotated will create a wellbore 16 in a subterranean earthen formation 18. The drill bit 14 is rotated by operation of a downhole motor or turbine 20 which is operated by the flow of drilling fluid passed through the interior of the drill string 12 from pumps (not shown) at the earth's surface, as is well known to those skilled in the art.

When a deviated or horizontal wellbore 16 is to be drilled, it is common to include electronic equipment that can provide signals to the operator at the earth's surface that indicates the direction and inclination of the wellbore 16. This equipment is usually referred to as Measurement-While-Drilling (MWD) equipment, and same is shown included in the drill string 12 by reference numeral 22. Additionally, in one preferred use of the present invention, the fluid circulation apparatus 10 is used in conjunction with one or more pieces of specialized equipment adapted to permit drilling with coiled tubing. These pieces of equipment are generally indicated by reference numeral 24, and are fully described in commonly assigned U.S. Pat. Nos. 5,314,032; 5,316,094; and 5,323,853 and copending and commonly assigned U.S. patent application Ser. No. 08/063,619 filed May 18, 1993 now U.S. Pat. No. 5,348,040; U.S. patent application Ser. No. 08/142,733 filed Oct. 25, 1993 now U.S. Pat. No. 5,373,898; and U.S. patent application Ser. No. 08/166,245 filed Dec. 13, 1993 now U.S. Pat. No. 5,394,951, all of which are incorporated herein by reference.

As will be described in more detail below, the MWD equipment 22 provides its signals through mud pulses, pulses of acoustic and/or electromagnetic energy, and/or signals through dedicated conduits or wires to a control and display panel 26 at the earth's surface, all as is well known in the art. Further, the control and display panel 26 is used for the operation of the coiled tubing drilling equipment 24 and the fluid circulation apparatus 10, which both require the use of electronic and/or fluidic signals sent to the downhole equipment through dedicated hydraulic fluid control lines 28. These control lines 28 can be suspended within the interior of the bore of the drill string or preferably (as shown in U.S. Pat. No. 5,348,090) provided within a void or bore within the wall of the coiled tubing.

Figure 2:
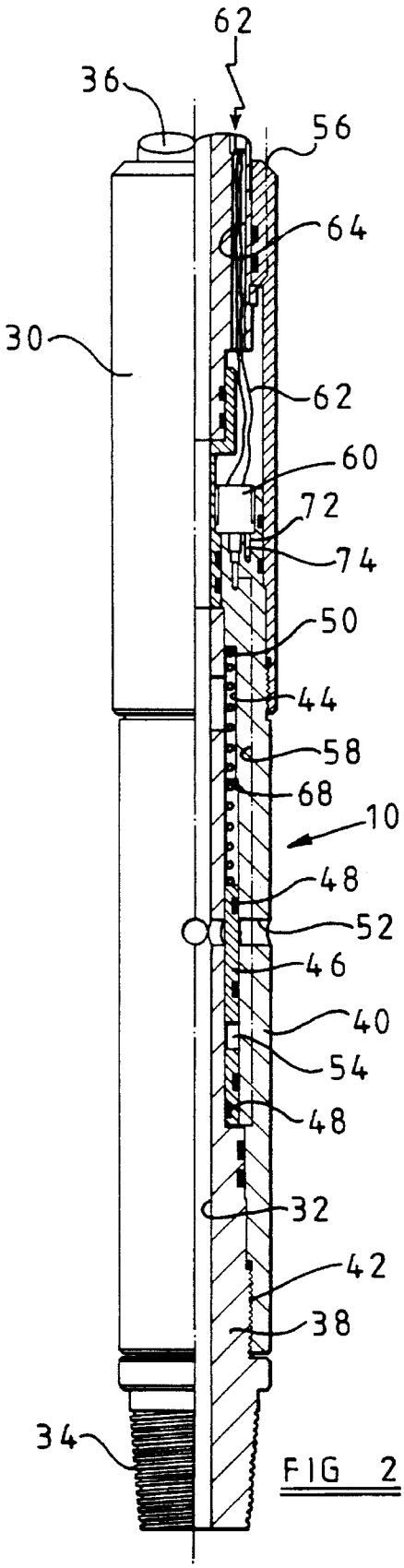
FIG. 2 is a cross-sectional side view of the one preferred embodiment of the fluid circulation apparatus embodying the present invention show the fluid circulation ports in a closed position.
Figure 3:
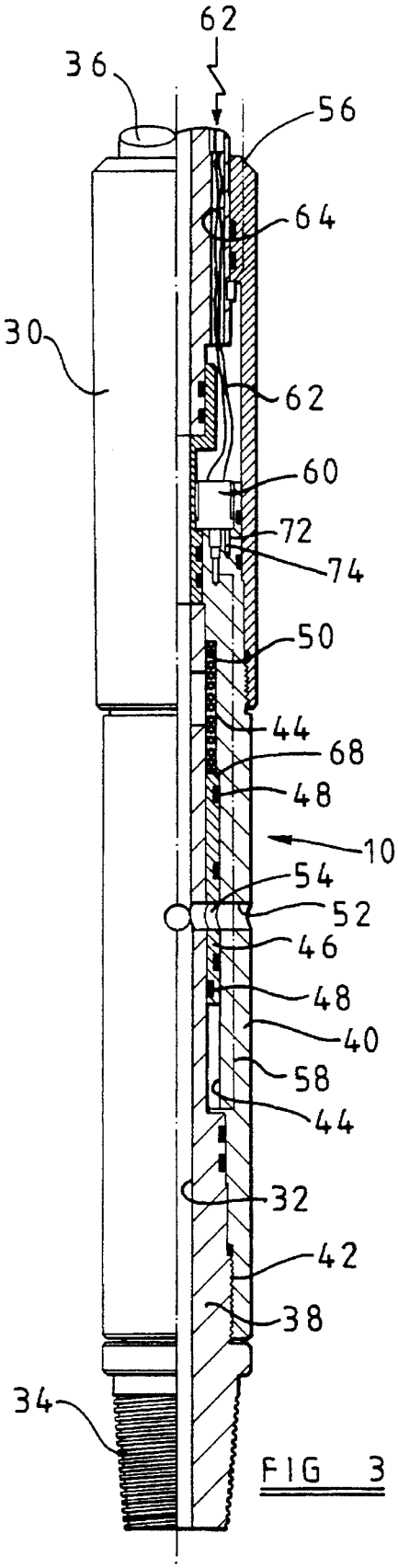
FIG. 3 is a cross-sectional side view of the preferred embodiment of the fluid circulation apparatus shown in FIG. 2 showing the fluid circulation ports in an open position.

As shown in FIGS. 2 and 3, the fluid circulation apparatus of one preferred embodiment of the present invention is comprised of a tubular body member 30 formed from a single piece of material or (as shown in FIGS. 2 and 3 ) formed from multiple tubular, coaxial pieces. The tubular body member 30 includes a longitudinal bore 32 extending therethrough for the passage of drilling fluid downwardly therethrough. Each end of the tubular body member 30 includes means for interconnection with the tubing string 12, and such means are in the form of a threaded pin 34 and a threaded box opening 36, as are well known in the art, or other suitable connection devices.

An inner tubular body 38 and an outer tubular body 40 are connected by way of cooperative threads 42 to form the major portion of the tubular body member 30. The configurations of the interior and exterior surfaces of the bodies 38 and 40 are such that an elongated gap or annular opening 44 is provided therebetween. Located within this annular opening 44 is a tubular sleeve 46 that is adapted to slide longitudinally within the opening 44. The sleeve 46 includes at least one sealing member 48 on each opposite surface thereof to form a fluidic seal within the opening 44. A helical spring 50 or other similar device is located within the opening 44 to act upon the sleeve 46 and urge it towards one end of the opening 44.

The side walls of the inner tubular body 38 and the outer tubular body 40 each include at least one, and preferably four equally radially spaced tangential fluid communication ports 52 to permit drilling fluid from the interior of the longitudinal bore 32 to pass into the annulus of the wellbore 16. The sleeve 46 also includes at least one tangential fluid communication port 54 spaced between at least two of the opposite stationed O-ring seals 48 to form a fluid seal about the port 54.

With the spring 50 normally extended (as shown in FIG. 2), the sleeve 46 is biased into a position so that the port 54 is not aligned with the ports 52. By action of the O-ring seals 48 and the non-alignment of the ports 52 and 54, drilling fluid is prevented from passing from the longitudinal bore 32 to the annulus. In other words, the spring 50 is used to bias the valve or sleeve 46 into a normally closed position. As will be described in more detail below, when hydraulic fluid is applied within the annular opening 44 at a pressure greater than the force from the spring 50, the sleeve 46 is moved to compress the spring 50 and bring the ports 54 and 52 into alignment. Once the ports 52 and 54 are in alignment, drilling fluid within the longitudinal bore 32 is permitted to pass into the wellbore's annulus for the purposes known to those skilled in the art of the use of a fluid circulation apparatus.

Hydraulic fluid, which is used to move the sleeve 46 to open the valve, is provided from the earth's surface by way of one or more conduits or control lines 28, as has been generally described above. This hydraulic fluid can be supplied through a dedicated control line which is used only to open and close the valve 46, in a manner similar to that described in U.S. Pat. No. 5,236,047. Preferably, however, the hydraulic fluid passes through an opening 56 in the sidewall of the coiled tubing string 12 and is used to operate one or more downhole tools and pieces of equipment 24, as described in detail in the above identified commonly assigned U.S. Patents and U.S. Patent Applications. In like manner, the side wall of the tubular body member 30 includes an opening or passageway 58 to provide for hydraulic fluid to enter the opening 44, as will be described below.

The present invention can be used with a common hydraulic fluid source but operate independently therefrom so that other downhole tools can be operated. Further, the present invention can be used adjacent to extremely sensitive MWD equipment because it utilizes relatively low electrical power to operate the valve device. To control the application of hydraulic fluid to the opening 44 independently from any other items of downhole equipment 24, a separately operable valve device 60 is provided within the tubular body member 30, and is in fluidic communication with the bore 56 in the sidewall of the coiled tubing string 12 and the opening 58 that passes hydraulic fluid to the opening 44 to move the sleeve 46. The valve device 60 can be any commercially available fluid control valve that opens or closes a fluid passageway (ie. the opening 58) by the application of mechanical motion from a separate control source. The separate control source can be a separate hydraulic control line or, preferably, the control source is the application of electrical energy. In one preferred embodiment of the present invention, the valve device 60 is an electrically operated piloting solenoid valve sold by The Lee Company, Westbrook, Conn., and it requires relatively low power, such as 28 volts DC and 0.1 amperes. If only electrical power was used to move the sleeve, such as by a solenoid coil rather than the continuation of hydraulic and electrical power, the amount of electrical energy needed to move the sleeve would create a magnetic field that would cause errors in the signals received within the MWD equipment.

The valve device 60 is normally dosed so that no hydraulic fluid will pass therethrough unless a specific application of electrical energy is received thereby. Further, a one-way check valve 61 is provided on the line 56 to prevent hydraulic fluid from passing out from the opening 44 in the event hydraulic pressure is lost. Also, the check valve 61 allows independent operation of the equipment 24 up-stream from the fluid circulation apparatus. This set-up of the fluid circulation apparatus 10 is to ensure that it is fail-safe. In other words, if electrical power is lost, the other downhole equipment 24 that requires the use of the hydraulic fluid will not be affected.

Electric control signals are provided to the valve device 60 through wires 62 which extend to the earth's surface through the interior of the coiled tubing string 12 or preferably through openings in a side wall of the coiled tubing string 12 and the tubular body member 30. A bore 64 for the wires 62 in the side wall of the tubular body member 30 is preferably similar to but separate from the hydraulic fluid openings 56 and 58.

Figure 4:
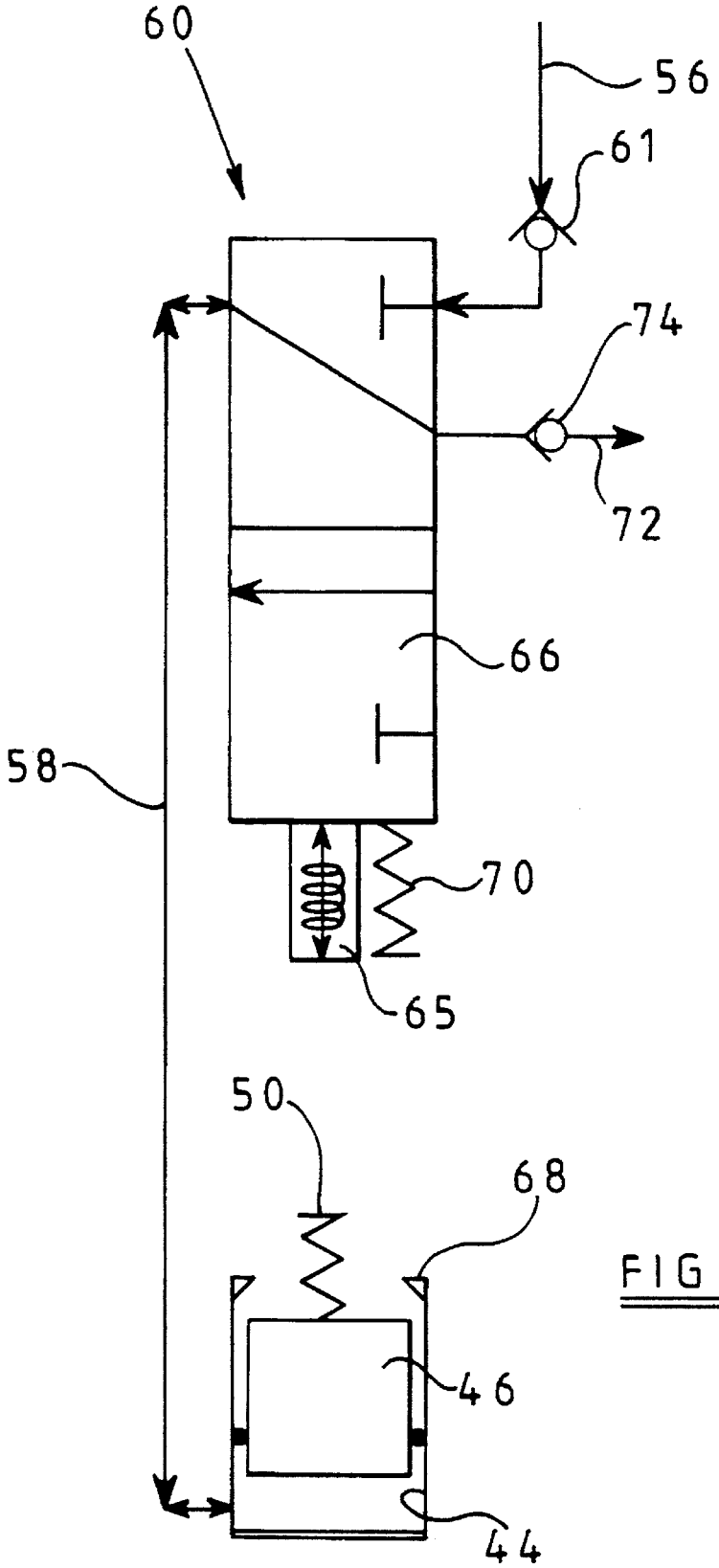
FIG. 4 is a schematic drawing of the solenoid valve used in one preferred embodiment of the present invention.

In the operation of the present invention described above, the tubular body member 30 is threadedly connected to the tubing string 12 together with the other equipment 14, 20, 22 and/or 24. The control wires 62 are operatively connected to the surface controls 26. And, the source of hydraulic fluid is operatively connected to the bore or opening 56. During the drilling operation, hydraulic fluid is passed downwardly into the drill string 12 through its dedicated conduit and is used to operate various pieces of downhole equipment 24, as described in detail in the above identified commonly assigned U.S. Patents and U.S. Patent Applications. When the operator determines that circulation of drilling fluid is needed, an electrical signal is sent from the surface controls 26 through the wires 62 to the valve device 60. As shown in FIG. 4, an internal solenoid 64 in the valve device 60 is energized to move to open the hydraulic fluid valve 66 therein. Hydraulic fluid then flows through the opening 58 to the annular opening 44 to push the sleeve 46 against the spring 50. The sleeve 46 compresses the spring 50 so that the port 54 comes into alignment with the ports 52 so as to permit fluid flow from the interior of the longitudinal bore 32 to the wellbore's annulus. To ensure that the ports 52 and 54 are aligned and to prevent overstressing the spring 50, an annular ledge or downstop 68 on the outerbody 40 extends into the opening 44.

When the operator determines that the flow of drilling fluid to the annulus should cease, the operator adjusts the surface controls 26 so that electrical energy is no longer applied to the valve device 60. Thus, the internal solenoid 64 in the valve device 60 closes by action of a spring 70 to shut off the flow of hydraulic fluid to the opening 44. The spring 50 then moves the sleeve 46 to a position where the ports 54 and 52 are not in alignment to stop the flow of drilling fluid out therefrom. Hydraulic fluid in the opening 44 is vented to the annulus through an opening or bore 72, which is provided with a one-way check valve 74 to prevent the in-flow of wellbore fluid.

As has been described above, the present invention permits the use of a fluid circulation apparatus within horizontal wellbores because it does not need use the dropping of a ball or bar for its operation. The present invention is resettable to a closed position, and as such can be operated as desired.

Whereas the present invention has been described in relation to the drawings attached hereto, it should be understood that other and further modifications, apart from those shown or suggested herein, may be made within the scope and spirit of the present invention.

What is claimed is:

1. A fluid circulation apparatus for interconnection with a wellbore tubing string, comprising:

a tubular body member having a longitudinal bore extending therethrough, and having means for interconnection with a tubing string;

at least one fluid communication port extending through a sidewall of the tubular body member;

valve means for selectively permitting and preventing fluid flow through the fluid communication port;

means for biasing the valve means in a normally closed position; and fluid control means comprising an electrically operated valve mounted within a space within the tubular body member, and adapted to selectively apply hydraulic fluid sent through a control line from the earth's surface to operate the valve means in response to electrical signals sent by wires to the control means from the earth's surface.

2. A fluid circulation apparatus of claim 1 wherein the tubing string is coiled tubing.

3. A fluid circulation apparatus of claim 1 wherein the means for interconnection comprise threaded pipe connections.

4. A fluid circulation apparatus of claim 1 wherein the valve means comprises a tubular sleeve adapted to slide longitudinally within an interior annular space within the tubular body member, the sleeve having at least one port therethrough.

5. A fluid circulation apparatus of claim 4 wherein the means for biasing the valve means comprises a spring within the annular space.

6. A fluid circulation apparatus of claim 1 wherein hydraulic fluid is supplied to the fluid control means through a conduit within the tubing string and hydraulic fluid is supplied from the fluid control means to valve means through an opening in a sidewall of the tubular body member.

7. A fluid circulation apparatus of claim 6 wherein the conduit conveying hydraulic fluid to the fluid control means is in operative fluidic communication with separately operable equipment connected to the tubing string.

* * * * *